US005448935A

United States Patent [19]

Kosinar

[11] Patent Number: 5,448,935

[45] Date of Patent: Sep. 12, 1995

[54] BRIDGE FOR STRINGED MUSICAL INSTRUMENT

[76] Inventor: Stephen M. Kosinar, 2042 Roxanne, Long Beach, Calif. 90815

[21] Appl. No.: 121,209

[22] Filed: Sep. 14, 1993

[51] Int. Cl.[6] ..... G10D 3/04

[52] U.S. Cl. ..... 84/298

[58] Field of Search ..... 84/298, 307, 297 R

[56] References Cited

U.S. PATENT DOCUMENTS 4,281,576 8/1981 Fender ..... 84/298

4,742,750 5/1988 Storey ..... 84/313

*Primary Examiner*—Michael L. Gellner

*Assistant Examiner*—Patrick J. Stanzione

[57] ABSTRACT

An adjustable bridge for a stringed musical instrument comprising of a base member including a first section, which is fixedly mounted to the body of the instrument, with a second section at the rear of the first section extending some distance above the top surface of the first part. The base member including a plurality of slots for receiving individual engagement devices corresponding to and aligned for supporting each of the strings. Each engagement device generally comprising of a string engager and a mount. The string engager having a second section for support of the string. The engagement devices are positioned in their individual slots and both sections of the engagement device are held in frictional contact with each other and the assembly is in frictional contact with the base member. An intonation adjusting screw is provided for individual adjustment of each engagement device longitudinally in the direction of the string an height adjusting screw is provided for adjusting the suing engager in an arc, generally vertically, with respect to the base member. A blocking means is added to the base member in the bottom of its rear section to hold the position of the intonation adjusting screw within its respective slot. String retainers holes provided for each of the individual strings to anchor them to the bridge at the rear section of the base member, at an angle thereto, so as to apply a force to urge the strings into contact with the engagement device and to reduce unwanted vibration of the string along its unplayed section behind the strings intonation point.

3 Claims, 3 Drawing Sheets

BRIDGE FOR STRINGED MUSICAL INSTRUMENT

BACKGROUND OF THE INVENTION

The present invention relates to a bridge for stringed musical instruments and, more particularly, to a stringed instrument bridge with individually adjustable engagement devices, corresponding to each string of the instrument, which increase the tone sustaining capabilities and harmonic content of the strings and eliminates certain undesirable characteristics and functions of bridges used heretofore.

Adjustable bridges of various types have been utilized for stringed musical instruments for a number of years. The function of the bridge for a stringed musical instrument is to provide a fixed connection point for the strings to the body of the instrument. A number of these prior art devices include individual bridge elements to provide for individual adjustment of the strings in one or more directions. These individual adjustments are provided in order to achieve proper intonation and action adjustment of the strings.

Prior art bridges have provided various means for performing the functions indicated above. The most common approach is to provide a plurality of drums or pedestals each engaging a respective one of the instruments strings. In these prior art devices the height adjustment requires that generally two separate screws be adjusted for each of the individual members in order to adjust the height of the string relative to the instrument. In addition, these members are adjusted longitudinally with respect to the string by an additional screw requiring a spring, or other biasing means, to maintain the bridge element in its general position with respect to the longitudinal adjusting screw and the rear section of the base member.

While bridges of the above mentioned prior art provide for the adjustability required, they create certain unwanted problems. That is, the drums, or pedestals each connected to, and come into contact with, the bridge base only by the adjustment screws. As a result, the vibrations of the strings, which are conducted over such drums or pedestals, cause the drums or pedestals themselves to vibrate and cause unwanted movement. These vibrations also cause the adjustment screws and biasing means, if any, to also vibrate and this vibrational movement causes a loss of the strings vibrational energy. This significantly weakens the ability of the bridge to transmit the string vibrations to the instrument body and therefore adversely effects the sustain characteristics of the instrument below the level which is theoretically attainable. Further, these unwanted vibrations cause frequencies to be added to the tone being produced by the strings, causing a phase cancelling effect at certain frequencies, thereby also causing a lack of definition in the overall tone of the instrument. Since the tone sustaining capability of a string is a direct function of the rigidity of its end point connections, it can be seen that the above mentioned means can be detrimental to the sustaining capabilities and harmonic content being produced by the vibrating string. Ideally, there should be no unwanted vibration of any of the bridge members and there should be solid contact all the way from the strings resting point to the instrument body.

SUMMARY OF THE INVENTION

According to the present invention, as embodied and broadly described herein, there is provided a novel adjustable bridge for stringed musical instruments. However, the present bridge substantially reduces unwanted vibrations and movement and provides for adjustment of the contact point at which the string is coupled to the instrument body in a convenient and practical manner while substantially increasing the tone sustaining capabilities and harmonic content of each string over that obtainable heretofore. Further, the present bridge substantially reduces the loss of the strings vibrational energy.

The bridge of this invention comprises a base member which includes a first section with a surface connectable to the body of the instrument and a second section at the rear of the first section extending some distance above the top surface of the first section preferably made integral with the first part. The base member also includes a plurality of slots for receiving the individual engagement devices.

The invention further resides in the construction of a plurality of individual engagement devices corresponding to and aligned for supporting each of the strings. Each engagement device may generally comprise of a string engager, which includes a second section upon which the string rests, and a mount which receives the string engager of the engagement device. Each engagement device is inserted into one of a plurality of slots, therein arranged side by side in the first section of the base member, for movement along its length parallel to the strings. The individual engagement devices also include a plurality of first and second threaded members for individual bi-directional adjustment of each of the engagement devices with respect to its corresponding string. The first threaded member is for adjustment of each of the engagement devices longitudinally parallel to its respective string and the second threaded member is for adjusting the position of the string engager of the engagement device in an arc generally vertically with respect to the base member.

Still further, the bridge includes a blocking means which is received through an opening in the bottom of the rear of the base member for locking the first threaded member in place within its respective slot in the base member. This secures the first threaded member against movement parallel to the slot as could be caused by vibration of the strings of the instrument. Additionally, this blocking means thereby omits the need of a spring, or other biasing means, to maintain the engagement device in its general position with respect to the first threaded member and the rearward section of the base member.

The base member also includes a plurality of holes extending through the rearward end of the base member which continue through the blocking means which is received by the base member. This allows for the adjustment of the first threaded member for the purpose of moving the respective one of the engagement devices toward or away from the second section of the base member to separately adjust the length of each string.

Still further, the base member also includes a plurality of string retainers, one for each of the engagement devices, for receiving and anchoring the strings to the base member offset thereto. As a result, this applies a force to urge the strings into contact with the string engager of the engagement device and to urge its respective second threaded member into contact with the mount of the engagement device. This contact of the strings with the string engager of the engagement device, behind its respective second section upon which the string rests, thereby also reduces any unwanted string vibration along the section of the string behind its resting point and its anchoring section. In a preferred embodiment of the engagement device, the top section of the string engager of the engagement device and the radius at the rear and bottom section of the string engager is in frictional contact with the mount of the engagement device so as to restrain the engagement device from any unwanted movement or vibration. In a conventional bridge, the vibrational movement of the saddles, or other means, may further cause the adjustment means to vibrate thereby altering the harmonic adjustment of the strings as well as decreasing the height of the strings relative position above the neck of the instrument. Further, in a preferred embodiment of the engagement device configuration this provides for a relatively solid, metal-to-metal contact all the way from the strings resting point to the instrument body.

It is, therefore, a principal object of the present invention to solve the problems caused by the ability of drums, pedestals or other moving means to vibrate in a bridge device for stringed musical instruments. It is a feature of the present invention to solve these problems by providing individual engagement devices to improve the accuracy and ease of adjustment of a bridge for stringed musical instruments. A further advantage is that the engagement devices engage in frictional contact, in a rigid positive engagement, within their respective slots in a vibrationless manner. The above advantage thereby substantially reducing any unwanted vibration which can reduce the strings vibrational energy and tone sustaining capabilities. Another advantage is that it also reduces any unwanted frequencies which, when left unchecked, cause phase cancellation effects of the desired note(s) which also deter the development of the natural overtone series of the desired note(s) and causes a lack of definition in the desired response of the instrument.

While the invention has been described with respect to the preferred physical embodiment constructed therewith, it will be apparent to those skilled in the art that various modifications or improvements may be made in the structure of the invention without departing from the scope of the invention.

Still other objects, features and attendant advantages of the present invention will become apparent to those skilled in the art as set forth in the following detailed description of the preferred embodiment constructed in accordance therewith.

BRIEF DESCRIPTION OF THE DRAWINGS

The accompanying drawings, which are incorporated in and constitute a part of the specifications, illustrate a preferred embodiment of the invention and, together with the general description given below, serve to explain the principles of the invention.

Figure 1:
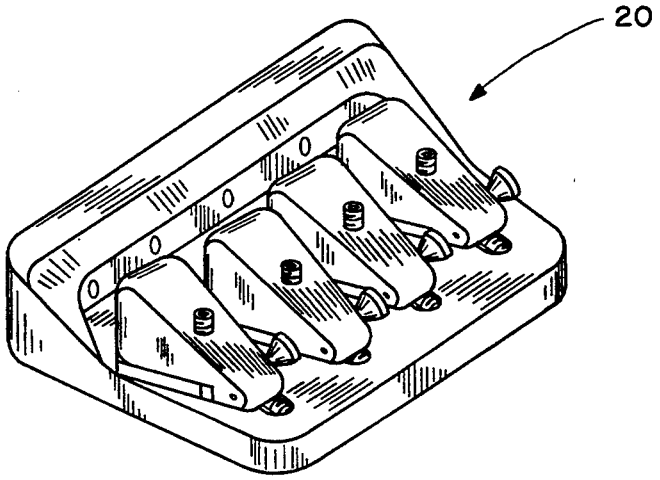
FIG. 1 is a perspective view of the present invention.
Figure 2:
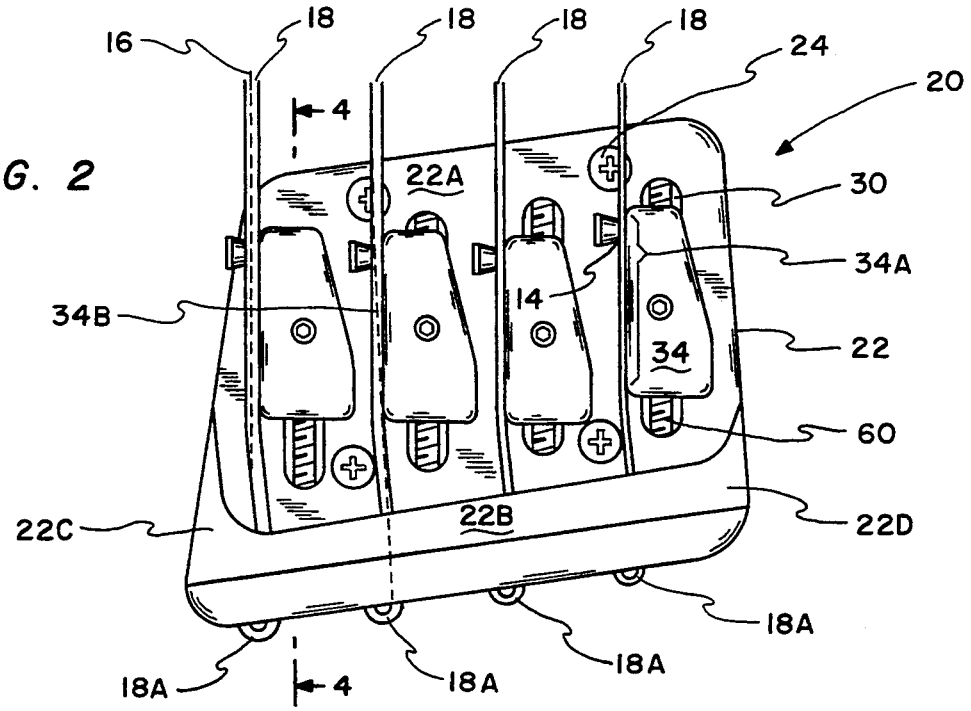
FIG. 2 is a top plan view of the present invention.
Figure 3:
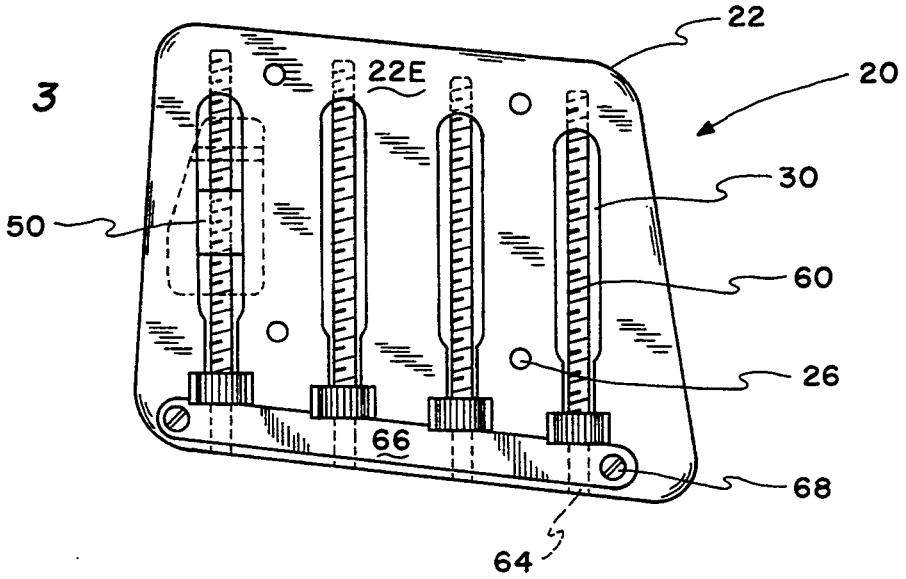
FIG. 3 is a bottom plan view of the present invention.
Figure 4:
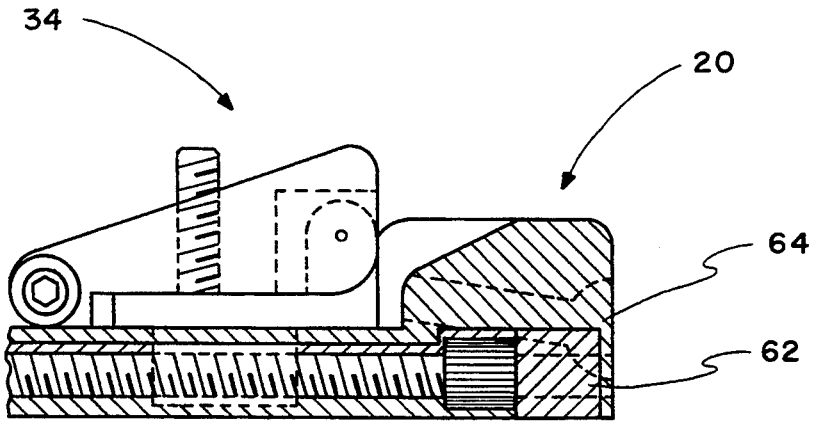
FIG. 4 is a longitudinal section taken on line 4—4 of FIG. 2.
Figure 5:
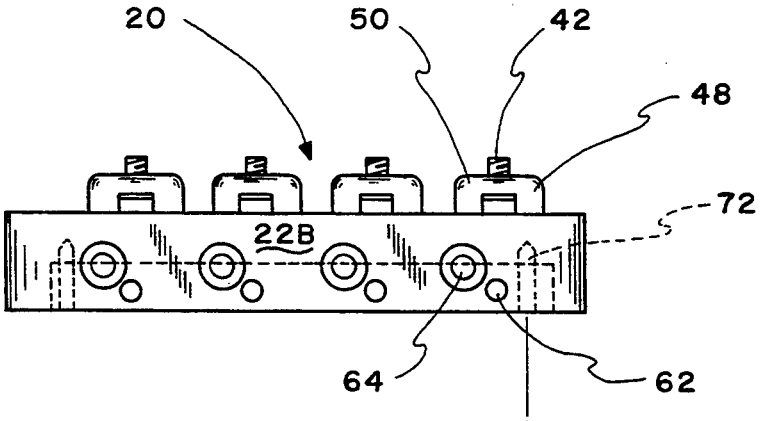
FIG. 5 is a rear elevation view of the present invention.
Figure 6:
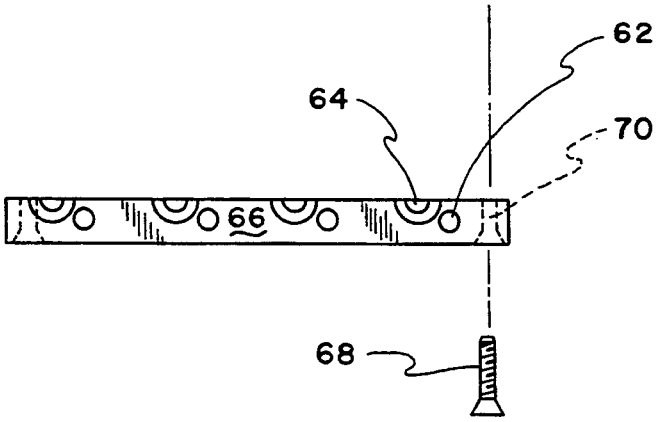
FIG. 6 is a rear view of the screw block as shown in FIG. 3.
Figure 7:
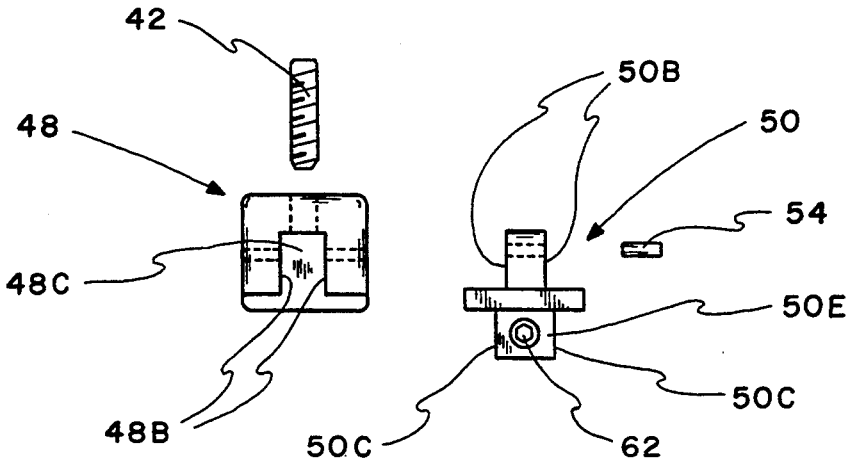
FIG. 7 is an exploded rear view of the engagement device as shown in FIGS. 2, 4 and 5.
Figure 8:
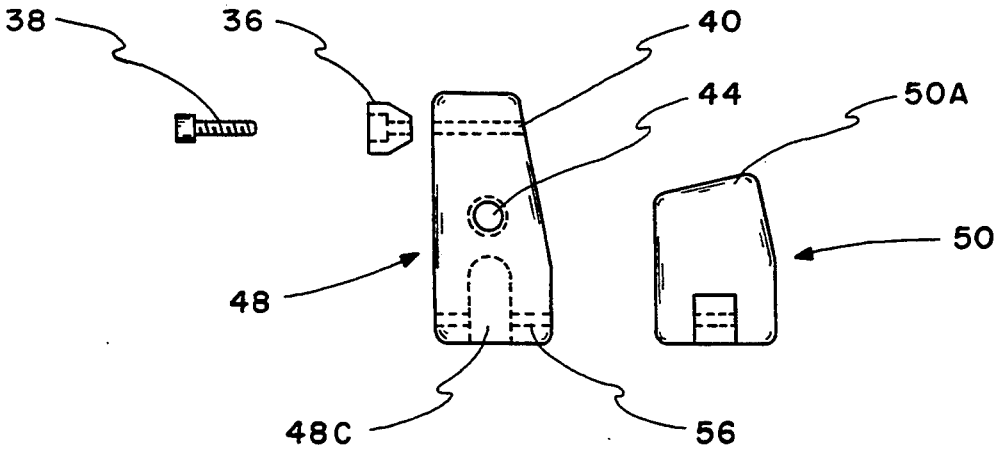
FIG. 8 is an exploded top view of the engagement device as shown in FIG. 7.
Figure 9:
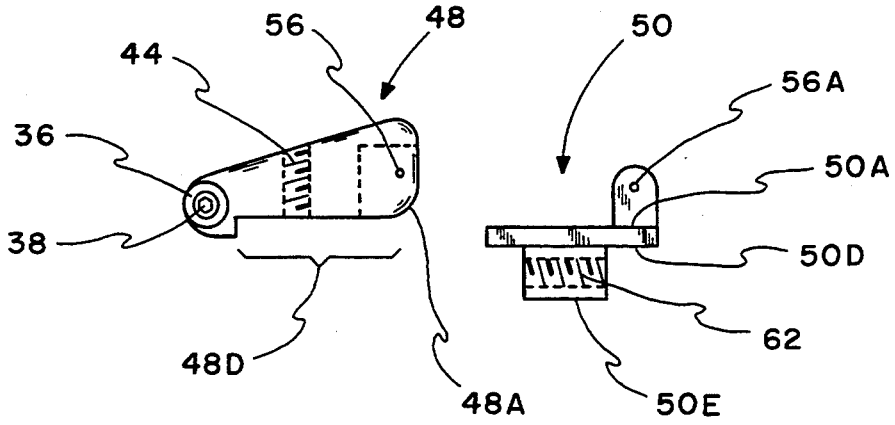

FIG .9 is an exploded side view of the engagement device as shown in FIGS. 7 and 8.

DESCRIPTION OF THE PREFERRED EMBODIMENT

Referring to the drawings, there is shown a bridge 20 for use with a stringed musical instrument (not shown) including a body, a neck portion extending from the body, a plurality of strings extending over a part of the body and the neck portion, a means for securing the strings at one end of the neck portion to hold them in a fixed position and also a means by which their tension is adjusted for tuning purposes. The practical embodiment of bridge 20 shown is designed for an electric bass guitar having four strings.

Bridge 20 has a base member 22 having a first plate section having generally flat bottom surface 22E which in use is intended to engage the top surface of the body of the instrument with which it is used. Connection of bridge 20 to the body of an instrument may be achieved by providing multiple holes in base member 22, such as mounting screw holes 26 in first section 22A. Mounting screws 24 extending through mounting screw holes 26 aligned with holes in the body of the instrument may be used to firmly secure bridge 20 to the instrument.

At one of the four ends of base member 22, base member has a second section 22B which tapers down to meet first section 22A at left and right sections 22C and 22B and 22D. Sections 22B, 22C and 22D preferably made integral with section 22A to provide a unitary construction. Second section 22B has two sets of adjacent holes, intonation adjusting screw holes 62 and string retainer holes 64 therein. These intonation adjusting screw holes 62, having their axis parallel to the plane of first section 22A and parallel to the direction of the intonation adjusting screw 60 and string retainer holes 64 having their axis offset to the plane of first section 22A and the direction of the strings 18 as shown by string parallel 16 and imaginary line connecting second section with string retainer hole 34B. Holes 64 provide retainers for capturing one end of individually associated ones of the strings The bridge 20 has a plurality of engagement devices 34 which are comprised of string engaging means engagers 48 and mounts 50 with a pivot pin 54 which holds them together in a fixed relationship to each other. In addition there is also a second section 36 and its fastening screw 38. Two adjustment means are added to the engagement device 34. One height adjusting screw 42 is to adjust the height of the string 18 and an intonation adjusting screw 60, to adjust the intonation of the string 18 and also to lock the mount 50 of the engagement device 34 into place within its respective slot 30 in the base member 22. As can be seen, there is an engagement device 34 for each string 18, each engagement device 34 consisting of a string engager 48 and mount 50 and their related parts.

The string engager 48 of the engagement device 34 pivots in an arc vertically in respect to the base member 22. Lateral movement is completely restricted by the means by which it is mounted to the mount 50 of the engagement device 34. It is fastened to the mount 50 by a pivot pin 54 which is press fit in the string engager 48 through a bore 56 and is inserted through the mount 50 through the bore 56A. The combination of this assembly not only omits any unwanted vibration but prohibits the sections from any unwanted movement. The mount 50 has a top section 50B which is received by the first section 48C of the string engager 48. The relation of the contacting surfaces of inside surface 48B and top section 50B insures that there is no unwanted movement or vibration of the engagement device 34. Contact of the sections is also added by means of the radius 48A at the rear and bottom section of the string engager 48 which is also in contact at all times with the mount 50 at top surface 50A insuring that this contact is always maintained at any height it is adjusted to. This provides a solid, high mass metal-to-metal connection between the string 18, the strings contact point 14 and the instrument body.

The second section 36 is fastened to the string engager 48 of the engagement device 34 by means of the threaded member 38 which is received by the string engager 48 through a threaded hole 40. This gives the string its contact point 14 which is the point from which its harmonic intonation and string height is based. This function is not limited to the above means, but can also be accomplished by having the second section 36 an integral part of the string engager 48, which would be obvious to a person having prior skill in the art. It should be noted that the string retainer holes 64 are offset relative to the contact point 14 of the string 18 at the second section 36. This causes the strings 18 to extend at an angle so as to urge the strings into contact behind the second the rigid side contact area 36 along section 34A of the engagement device 34 and also to increase the tension of the string 18 from its contact point 14 to its ball end 18A when received by the string retainer 64. This urging of the string 18 helps to eliminate any unwanted vibration of string 18 along its unplayed section behind its contact point 14 and its respective string retainer holes 64.

The height adjustment of the engagement device 34 is accomplished by means of an height adjuster screw 42 inserted through a threaded hole 44 in the string engager 48 of the engagement device 34. Also, due to the design of the assembly, its ability to vibrate is limited reducing the chance of changing its relative position.

The intonation adjusting screw 60 is locked in place by the blocking means 66 inserted through the bottom of the base member 22 thereby omitting the need of a biasing spring. Other methods of locking the intonation screws in place within its respective slot in the base member are within the scope of this invention as would be apparent to those skilled in the art. This design, coupled with the engagement device 34 and its position in the base member 22, further reduces the cause of unwanted vibrations as in the prior art. These engagement devices 34 and the base member 22 are preferably made of brass but can be made from any other metal or suitable material.

It can therefore be seen, that according to the present invention, the undesirable characteristics and problems encountered heretofore with prior bridge devices for stringed musical instruments has been solved.

Bridge 20 includes a plurality of engagement devices 34 of novel design mounted within individual slots 30 in base member 22 which permit separate adjustment of the height of each string 18 and the adjustment of the length of each individual string 18. However bridge 20 substantially reduces unwanted vibration and movement, substantially increasing the strings attack, vibration, tone, harmonics and the natural overtone series over that obtainable heretofore. Thus bridge 20 is a practical, unique and desirable solution to the problems addressed herein.

While the invention has been described with respect to the preferred physical embodiment, constructed in accordance therewith, it will be apparent to those skilled in the art that various modifications and variation or improvements may be made in the structure of the invention without departing from the scope of the invention.

What is claimed is:

1. A bridge for a stringed musical instrument, said bridge comprising:

a base member having a first plate section which is connectable to and lies flat upon said instrument, said base member having a second plate section raised above a rear edge of said first plate section;

said second plate section having a pair of holes individually associated with each of a plurality of strings secured to said instrument via said bridge, one of each of said pair of holes receiving and securing an end of an individually associated string, the other of each of said pair of holes extending parallel to said individually associated strings;

a plurality of intonation adjustment screws held captive in said base member;

a plurality of spaced parallel elongated slots formed in said first plate section, each of said slots having spaced parallel side walls and being individually associated with a corresponding one of said intonation adjustment screws, said other of said pair of holes providing a means for adjusting said corresponding intonation adjustment screw;

a plurality of elongated string engaging means longitudinally sliding within individually associated ones of said slots, said elongated string engaging means having spaced parallel side walls, the geometric relation between said slot and said string engaging means being loose enough to enable the string engaging means to slide and tight enough to prevent substantially all transverse vibrating movement of said string engaging mean when the string individually associated therewith is plucked, said strings passing over individually associated ones of said string engaging means, said string engaging means being positioned at locations within said slots selected by an adjustment of the intonation screw associated with that slot;

means for pivotally supporting said string engaging means for enabling a height adjustment of the individually associated string passing over said elongated string engaging means; and means for adjusting the pivoted height independently of the longitudinal sliding location of said string engaging means, said holes for receiving and securing said ends of said individually assorted strings being off-set in a direction toward and lower than a lowest height of said string engaging means.

2. The bridge of claim 1 wherein the relative dimensions of said slots, said intonation screws, and said string engaging means therein is such that said longitudinal sliding is far enough to tune and adjust the pitch of said associated string while inhibiting lateral movement of said string engaging means within said slots.

3. The bridge of claim 1 wherein said string engaging means is shaped to fix a dividing point on said string where vibrations thereof may occur on one side of said point but not on another side of said point.

* * * * *